US011441562B2

(12) United States Patent
Lee et al.

(10) Patent No.: US 11,441,562 B2
(45) Date of Patent: Sep. 13, 2022

(54) SCROLL COMPRESSOR HAVING NOISE REDUCTION STRUCTURE

(71) Applicant: LG Electronics Inc., Seoul (KR)

(72) Inventors: Seungmock Lee, Seoul (KR); Cheolhwan Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 179 days.

(21) Appl. No.: 16/811,764

(22) Filed: Mar. 6, 2020

(65) Prior Publication Data

US 2020/0284256 A1 Sep. 10, 2020

(30) Foreign Application Priority Data

Mar. 8, 2019 (KR) ..... 10-2019-0026742

(51) Int. Cl.
*F04C 15/06* (2006.01)
*F04C 18/02* (2006.01)
(Continued)

(52) U.S. Cl.
CPC ..... *F04C 15/06* (2013.01); *F04C 18/0292* (2013.01); *F04C 29/065* (2013.01);
(Continued)

(58) Field of Classification Search
CPC .... F04C 15/06; F04C 18/0292; F04C 29/065; F04C 29/068; F04C 29/12; F04C 18/0215;
(Continued)

(56) References Cited

U.S. PATENT DOCUMENTS 4,764,096 A * 8/1988 Sawai ..... F04C 29/0057 418/55.5
4,877,382 A * 10/1989 Caillat ..... F01C 1/0215 418/55.5
(Continued)

FOREIGN PATENT DOCUMENTS

JP H08303365 11/1996
JP H08319963 12/1996
(Continued)

OTHER PUBLICATIONS

Extended European Search Report in European Application No. 20161769.3, dated Jun. 16, 2020, 7 pages.

*Primary Examiner* — Dominick L Plakkoottam
*Assistant Examiner* — Paul W Thiede
(74) *Attorney, Agent, or Firm* — Fish & Richardson P.C.

(57) ABSTRACT

Disclosed herein is a scroll compressor including a casing, a drive motor arranged in the casing, a shaft coupled to the drive motor, a main frame arranged under the drive motor, a fixed scroll arranged under the main frame, an orbiting scroll arranged between the main frame and the fixed scroll and engaged with the fixed scroll to form a compression chamber with the shaft eccentrically coupled to the orbiting scroll, a discharge cover coupled to the fixed scroll to form a closed space, a discharge port formed in the fixed scroll to connect the compression chamber and the closed space, and a discharge hole passing through the main frame and the fixed scroll, wherein an inlet and an inner portion of the discharge hole have different cross-sectional areas. The scroll compressor can reduce the noise caused by movement of the refrigerant by improving the structure of the discharge holes.

20 Claims, 8 Drawing Sheets

(51) Int. Cl.
*F04C 29/06* (2006.01)
*F04C 29/12* (2006.01)
*F04C 23/00* (2006.01)

(52) U.S. Cl.
CPC ..... *F04C 29/068* (2013.01); *F04C 29/12* (2013.01); *F04C 18/0215* (2013.01); *F04C 23/008* (2013.01); *F04C 29/06* (2013.01); *F04C 2240/603* (2013.01); *F04C 2250/102* (2013.01)

(58) Field of Classification Search
CPC .. F04C 23/008; F04C 29/06; F04C 2240/603; F04C 2250/102; F05B 2260/96
See application file for complete search history.

(56) References Cited

U.S. PATENT DOCUMENTS 5,125,810 A * 6/1992 Suefuji ..... F04C 18/0215 418/55.2
5,249,941 A * 10/1993 Shibamoto ..... F01C 21/001 418/55.5
5,257,920 A * 11/1993 Takeda ..... F04C 29/12 418/55.1
5,562,435 A * 10/1996 Cho ..... F04C 27/005 418/104
5,573,389 A * 11/1996 Fukuhara ..... F01C 21/02 418/55.5
5,863,191 A * 1/1999 Motegi ..... F04C 18/0253 418/55.1
6,047,557 A * 4/2000 Pham ..... F25B 1/04 62/228.5
8,007,261 B2 * 8/2011 Caillat ..... F04C 27/005 418/55.5
9,022,756 B2 * 5/2015 Oh ..... F04C 29/06 418/55.1
10,830,236 B2 * 11/2020 Ignatiev ..... F04C 29/0071
2005/0265878 A1 * 12/2005 Ishida ..... F04C 29/026 418/55.1
2011/0033327 A1 * 2/2011 Kim ..... F04C 29/12 418/55.1
2017/0306964 A1 10/2017 Kim et al.
2018/0266423 A1 9/2018 Ku et al.
2019/0309753 A1 * 10/2019 Jeon ..... F04C 29/0035

FOREIGN PATENT DOCUMENTS

KR 1020150071060 6/2015
KR 1020160017993 2/2016
WO WO2009061038 5/2009

* cited by examiner

SCROLL COMPRESSOR HAVING NOISE REDUCTION STRUCTURE

CROSS-REFERENCE TO RELATED APPLICATION

This application claims the benefit of Korean Patent Application No. 10-2019-0026742, filed on Mar. 8, 2019, which is hereby incorporated by reference as if fully set forth herein.

BACKGROUND

Technical Field

The present disclosure relates to a compressor having a noise reduction structure for reducing noise generated when a refrigerant moves in the compressor.

Discussion of the Related Art

Generally, a compressor is applied to a vapor compression type refrigeration cycle (hereinafter referred to simply as a refrigeration cycle) such as a refrigerator or an air conditioner. The compressor compresses the refrigerant to provide work necessary for heat exchange in the refrigeration cycle. Compressors can be divided into reciprocating compressors, rotary compressors, and scroll compressors according to how the refrigerant is compressed.

The reciprocating compressor is a system in which the volume of the compression space is varied while the piston reciprocates in the cylinder. The rotary compressor compresses the refrigerant while the rolling piston pivotally moves using the rotating force of the drive unit.

The scroll compressor is a compressor in which an orbiting scroll is engaged with a fixed scroll fixed in the inner space of a hermetically sealed container to perform an orbiting motion to form a compression chamber between a fixed wrap of the fixed scroll and an orbiting wrap of the orbiting scroll. When the orbiting scroll rotates, the refrigerant is introduced, compressed and discharged according to change of the volume of the compression chamber.

The scroll compressor is widely employed in air conditioners or the like to compress a refrigerant because it can obtain a relatively high compression ratio as compared with other types of compressors and can obtain a stable torque as the intake, compression and discharge operations of the refrigerant are smoothly connected to each other.

Scroll compressors may be divided into an upper compression compressor or a lower compression compressor depending on the positions of the drive motor and the compression unit. In the upper compression compressor, the compression unit is positioned over the drive motor. In the lower compression compressor, the compression unit is positioned under the drive motor.

Here, in the case of the lower compression scroll compressor, a discharge cover is hermetically coupled to the lower surface of the fixed scroll to prevent the refrigerant discharged from the compression chamber to the inner space of the casing from mixing with the oil contained in an oil reservoir space.

Referring to U.S. Patent Application Publication No. 2017/0306963A1, a conventional scroll compressor includes a case defining an outer appearance and having a discharge portion through which a refrigerant is discharged, a compression unit fixed to the case and configured to compress the refrigerant, and a drive unit is fixed to the case and configured to drive the compression unit, wherein the compression unit and the drive unit are connected by a rotary shaft rotatably coupled to the drive unit.

The compression unit includes a fixed scroll fixed to the case and having a fixed lap, and an orbiting scroll including an orbiting wrap engaging with the fixed wrap and driven by the rotary shaft. In the conventional scroll compressor, the rotary shaft is eccentrically disposed, and the orbiting scroll is fixed to the eccentric rotary shaft and rotated. Thereby, the orbiting scroll revolves (orbits) around the fixed scroll to compress the refrigerant.

The refrigerant compressed in the compression chamber of the compressor is discharged through the discharge port and moved back to the upper portion. Thereby, the refrigerant is recovered. The refrigerant reaches the upper portion through the discharge holes formed in the main frame and the fixed scroll. While the refrigerant passes through the narrow discharge holes, noise is generated by the movement of the refrigerant.

SUMMARY

An object of the present disclosure is to provide a compressor having a noise reduction structure for reducing noise generated when a refrigerant moves.

More specifically, an object of the present disclosure is to provide a compressor having a discharge hole having an optimum length and width according to the degree of generated noise.

The objects of the present disclosure are not limited to the above-mentioned objects, and other objects and advantages of the present disclosure which are not mentioned may be understood upon examination of the following description and more clearly understood upon examination of the embodiments of the present disclosure. The objects and other advantages of the disclosure may be realized and attained by means particularly pointed out in the appended claims.

To achieve these objects and other advantages and in accordance with the purpose of the present disclosure, as embodied and broadly described herein, a scroll compressor may include a casing, a drive motor, a main frame, a fixed scroll, an orbiting scroll, a discharge cover, a discharge port, and a discharge hole. The drive motor is included in the casing. The rotary shaft may be rotatable by the drive motor. The main frame may support the rotary shaft. The fixed scroll may be connected to the main frame. The orbiting scroll may be arranged between the main frame and the fixed scroll and eccentrically connected to the rotary shaft. The orbiting scroll may be configured to orbit relative to the fixed scroll and define a compression chamber in cooperation with the fixed scroll. The discharge cover may be disposed on a first surface of the fixed scroll to define a closed space between the discharge cover and the first surface of the fixed scroll. The discharge port may be defined at the fixed scroll and configured to fluidly connect the compression chamber to the closed space. The discharge hole may be defined through the main frame and the fixed scroll and configured to fluidly connect the closed space to an outside of the main frame. Opposite ends of the discharge hole may have cross-sectional areas that are different from a cross-sectional area of an inner portion of the discharge hole between the opposite ends.

In some implementations, the scroll compressor can optionally include one or more of the following features. The discharge hole may include a first discharge hole defined at the main frame, and a second discharge hole defined at the fixed frame and fluidly connected to the first discharge hole. The first discharge hole may have a plurality of openings defined at a first surface of the main frame and one opening defined at a second surface of the main frame. The second surface of the main frame may be opposite to the first surface of the main frame and facing the fixed scroll. The one opening may be fluidly connected to the plurality of openings through the main frame. The second discharge hole may have a plurality of openings defined at the first surface of the fixed scroll and one opening in a second surface of the fixed scroll. The second surface of the fixed scroll may be opposite to the first surface of the fixed scroll and facing the main frame. The one opening may be fluidly connected to the plurality of openings through the fixed scroll. The discharge hole may include an expanded flow channel. The expanded flow channel may have a cross-sectional area greater than the cross-sectional areas of the opposite ends of the discharge hole. The discharge hole may include a plurality of inlets and outlets defined at the opposite ends thereof. The expanded flow channel may fluidly communicate with the plurality of inlets and outlets. The discharge hole may include a first flow channel extending from one of the opposite ends, a second flow channel extending from the expanded flow channel to the other of the opposite ends, a first stepped portion between the first flow channel and the expanded flow channel, and a second stepped portion between the expanded flow channel and the second flow channel. The scroll compressor may be configured to reduce a noise of a wavelength corresponding to $(2n-1)/4$ times a length of the expanded flow channel better than a noise of a wavelength corresponding to $n/2$ times the length of the expanded flow channel, wherein n is a natural number. The scroll compressor may include a first flow channel guide recessed from the first surface of the fixed scroll in an area of the fixed scroll corresponding to the discharge hole. The scroll compressor may include a second flow channel guide recessed from a surface of the main frame in an area of the main frame corresponding to the discharge hole. The discharge hole may be defined at a sidewall of the main frame and a sidewall of the fixed scroll. The discharge cover may include a bottom, and a cover sidewall extending from an outer circumferential surface of the bottom and configured to be disposed on the fixed scroll. The cover sidewall may include a recessed portion corresponding to the discharge hole and recessed away from the discharge hole.

Particular embodiments described herein include a scroll compressor including a rotary shaft, a frame, a fixed scroll, an orbiting scroll, a discharge cover, and a discharge hole. The frame may support the rotary shaft. The fixed scroll may be connected to the frame. The orbiting scroll may be arranged between the frame and the fixed scroll and connected to the rotary shaft. The orbiting scroll may be configured to orbit relative to the fixed scroll such that a compression chamber is defined by the orbiting scroll and the fixed scroll. The discharge cover may be disposed on a first surface of the fixed scroll to define a space between the discharge cover and the first surface of the fixed scroll. The discharge hole may be defined through the frame and the fixed scroll and configured to fluidly connect the closed space to an outside of the main frame. Opposite ends of the discharge hole may have cross-sectional areas that are different from a cross-sectional area of an inner portion of the discharge hole between the opposite ends.

In some implementations, the scroll compressor can optionally include one or more of the following features. The discharge hole may include a first discharge hole defined at the main frame, and a second discharge hole defined at the fixed frame and fluidly connected to the first discharge hole. The first discharge hole may have a plurality of openings defined at a first surface of the main frame and one opening defined at a second surface of the main frame. The second surface of the main frame may be opposite to the first surface of the main frame and facing the fixed scroll. The one opening may be fluidly connected to the plurality of openings through the main frame. The second discharge hole may have a plurality of openings defined at the first surface of the fixed scroll and one opening in a second surface of the fixed scroll. The second surface of the fixed scroll may be opposite to the first surface of the fixed scroll and facing the main frame. The one opening may be fluidly connected to the plurality of openings through the fixed scroll. The discharge hole may include an expanded flow channel. The expanded flow channel may have a cross-sectional area greater than the cross-sectional areas of the opposite ends of the discharge hole. The discharge hole may include a plurality of inlets and outlets defined at the opposite ends thereof. The expanded flow channel may fluidly communicate with the plurality of inlets and outlets. The discharge hole may include a first flow channel extending from one of the opposite ends, a second flow channel extending from the expanded flow channel to the other of the opposite ends, a first stepped portion between the first flow channel and the expanded flow channel, and a second stepped portion between the expanded flow channel and the second flow channel. The scroll compressor may include a first flow channel guide recessed from the first surface of the fixed scroll in an area of the fixed scroll corresponding to the discharge hole, and a second flow channel guide recessed from a surface of the main frame in an area of the main frame corresponding to the discharge hole.

To achieve these objects and other advantages and in accordance with the purpose of the present disclosure, as embodied and broadly described herein, a scroll compressor may include a casing, a drive motor arranged in an inner space of the casing, a rotary shaft coupled to the drive motor to perform a rotational motion, a main frame arranged under the drive motor, a fixed scroll arranged under the main frame, an orbiting scroll arranged between the main frame and the fixed scroll and configured to make an orbiting motion in engagement with the fixed scroll to form a compression chamber in cooperation with the fixed scroll, the rotary shaft being inserted into and eccentrically coupled to the orbiting scroll, a discharge cover sealably coupled to an outer surface of the fixed scroll to form a closed space, a discharge port formed in the fixed scroll to connect the compression chamber and the closed space, and a discharge hole passing through the main frame and the fixed scroll to allow the closed space to communicate with an portion above the main frame, wherein an inlet of the discharge hole has a cross-sectional area different from a cross-sectional area of an inner portion of the discharge hole.

The discharge hole may include a first discharge hole formed in the main frame, and a second discharge hole formed in the fixed frame and connected to the first discharge hole.

The first discharge hole may have a plurality of openings formed in an upper portion of the main frame and integrated into one opening in a lower portion of the main frame.

The second discharge hole may have a plurality of openings formed in a lower portion of the fixed scroll and integrated into one opening in an upper portion of the fixed scroll.

The discharge hole may include an expanded flow channel having a cross-sectional area greater than a cross-sectional area of the inlet and outlet of the discharge hole.

The discharge hole may include a plurality of inlets and outlets, and the expanded flow channel integrating the plurality of inlets and outlets.

The discharge hole may include a first flow channel extending from the inlets, the expanded flow channel, and a second flow channel extending from the expanded flow channel to the outlets, wherein a step may be formed between the first flow channel and the expanded flow channel and between the expanded flow channel and the second flow channel.

The scroll compressor may be configured to reduce a noise of a wavelength corresponding to (2n−1)/4 times a length of the expanded flow channel better than a noise of a wavelength corresponding to n/2 times the length of the expanded flow channel, wherein n may be a natural number.

The scroll compressor may further include a first flow channel guide concavely depressed in a lower portion of the fixed scroll at a position corresponding to the discharge hole.

The scroll compressor may further include a second flow channel guide concavely depressed in an upper portion of the main frame at a position corresponding to the discharge hole.

The discharge hole may be formed on a sidewall of the main frame and a sidewall of the fixed scroll.

The discharge cover may include a bottom, and a sidewall surrounding a circumference of the bottom. A portion of the sidewall corresponding to a position of the discharge hole may be concavely depressed facing an outside.

It is to be understood that both the foregoing general description and the following detailed description of the present disclosure are exemplary and explanatory and are intended to provide further explanation of the present disclosure as claimed.

BRIEF DESCRIPTION OF THE DRAWINGS

The accompanying drawings, which are included to provide a further understanding of the present disclosure and are incorporated in and constitute a part of this application, illustrate embodiment(s) of the present disclosure and together with the description serve to explain the principle of the present disclosure. In the drawings.

DETAILED DESCRIPTION

Reference will now be made in detail to the preferred embodiments of the present disclosure, examples of which are illustrated in the accompanying drawings. Wherever possible, the same reference numbers will be used throughout the drawings to refer to the same or like parts.

Hereinafter, a scroll compressor according to an embodiment of the present disclosure will be described with reference to FIG. 1.

Figure 1:
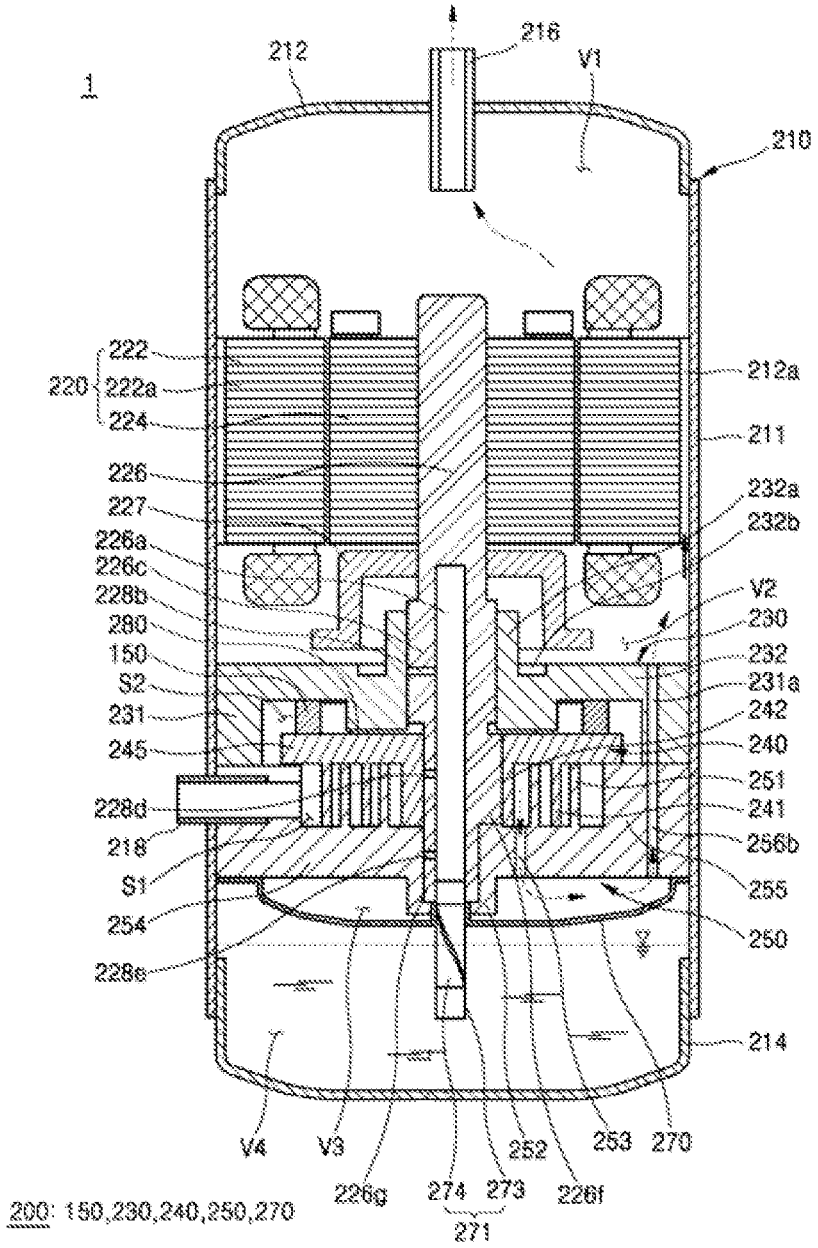
FIG. 1 is a cross-sectional view illustrating a scroll compressor according to an embodiment of the present disclosure.

FIG. 1 is a cross-sectional view illustrating a scroll compressor according to an embodiment of the present disclosure.

A scroll compressor 1 according to the embodiment of the present disclosure may include a casing 210 having an inner space, a drive motor 220 provided in an upper portion of the inner space, a compression unit 200 disposed under the drive motor 220, and a rotary shaft 226 configured to transmit the driving force of the drive motor 220 to the compression unit 200.

Here, the inner space of the casing 210 includes a first space V1, which is at an upper side of the drive motor 220, and a second space V2, which is a space between the drive motor 220 and the compression unit 200. The space under the fixed scroll 250 may be divided into a third space V3 (closed space) defined by a discharge cover 270 hermetically coupled to a lower portion of the fixed scroll 250, and a fourth space V4 (oil reservoir space), which is under the compression unit 200.

The casing 210 may have, for example, a cylindrical shape. Thus, the casing 210 may include a cylindrical shell 211.

An upper shell 212 may be provided to an upper portion of the cylindrical shell 211 and a lower shell 214 may be provided to a lower portion of the cylindrical shell 211. The upper and lower shells 212 and 214 may be joined to the cylindrical shell 211 by, for example, welding to define an inner space.

Here, the upper shell 212 may be provided with a refrigerant discharge pipe 216. The refrigerant discharge pipe 216 is a passage through which a compressed refrigerant discharged from the compression unit 200 to the second space V2 and the first space V1 is discharged to the outside.

For reference, an oil separator (not shown) for separating the oil mixed in the discharged refrigerant may be connected to the refrigerant discharge pipe 216.

The lower shell 214 may define an oil reservoir space V4 capable of storing oil.

The oil reservoir space V4 may function as an oil chamber for supplying oil to the compression unit 200 to allow the compressor 1 to smoothly operate.

Further, a refrigerant suction pipe 218 serving as a passage through which the refrigerant to be compressed is introduced may be provided on the side surface of the cylindrical shell 211.

The refrigerant suction pipe 218 may extend to a compression chamber S1 along the side of the fixed scroll 250 in a penetrating manner.

The drive motor 220 may be arranged in the upper operation of the casing 210.

Specifically, the drive motor 220 may include a stator 222 and a rotor 224.

The stator 222 may be cylindrical, for example, and may be fixed to the casing 210. The stator 222 has a plurality of slots (not shown) formed on the inner circumferential surface thereof in a circumferential direction such that a coil 222*a* is wound. In addition, the outer circumferential surface of the stator 222 may be cut into a D-cut shape to form a refrigerant flow channel groove 212*a* to allow the refrigerant or oil discharged from the compression unit 200 to pass therethrough.

The rotor 224 may be coupled to the inside of the stator 222 and may generate rotational power. The rotary shaft 226 may be precisely fitted into the center of the rotor 224 such that the rotary shaft 226 can rotate together with the rotor 224. The rotational power generated by the rotor 224 is transmitted to the compression unit 200 through the rotary shaft 226.

The compression unit 200 may include an Oldham ring 150, a main frame 230, a fixed scroll 250, an orbiting scroll 240, and a discharge cover 270.

The Oldham ring 150 may be arranged between the main frame 230 and the orbiting scroll 240 to prevent the orbiting scroll 240 from rotating on the axis thereof.

The main frame 230 may be provided under the drive motor 220 and form the top of the compression unit 200.

The main frame 230 may include a frame head plate 232 (hereinafter referred to as a first head plate) having a substantially circular shape, and a frame shaft support 232*a* (hereinafter referred to as a first shaft support) disposed at the center of the first head plate 232 and penetrated by the rotary shaft 226, and a frame sidewall portion 231 (hereinafter referred to as a first sidewall portion) protruding downward from an outer circumferential portion of the first head plate 232.

The outer circumferential portion of the first sidewall portion 231 may be in contact with the inner circumferential surface of the cylindrical shell 211, and the lower end of the first sidewall portion 231 may be in contact with the upper end of a fixed scroll sidewall portion 255, which will be described later.

The first sidewall portion 231 may be provided with a frame discharge hole 231*a* (hereinafter referred to as a first discharge hole) which forms a refrigerant passage by penetrating the first sidewall portion 231 in the axial direction. The inlet of the first discharge hole 231*a* may be connected to the outlet of a fixed scroll discharge hole 256*b*, which will be described later, and the outlet of the first discharge hole 231*a* may be connected to the second space V2.

The first shaft support 232*a* may protrude from the upper surface of the first head plate 232 toward the drive motor 220. In addition, the first shaft support 232*a* may be provided with a first bearing through which a main bearing 226*c* of the rotary shaft 226, which will be described later, is arranged so as to be supported.

That is, the first shaft support 232*a*, through which the main bearing 226*c* of the rotary shaft 226 constituting the first bearing is rotatably inserted and supported, may be formed at the center of the main frame 230 in the axial direction.

An oil pocket 232*b* for collecting oil discharged from a gap between the first shaft support 232*a* and the rotary shaft 226 may be formed in the upper surface of the first head plate 232.

Specifically, the oil pocket 232*b* may be engraved on the upper surface of the first head plate 232 and be formed in an annular shape along the outer circumferential surface of the first shaft support 232*a*.

A back pressure chamber S2 may be formed on the bottom surface (i.e., the lower surface) of the main frame 230 to define a space together with the fixed scroll 250 and the orbiting scroll 240 such that t the orbiting scroll 240 is supported by the pressure in the space.

For reference, the back pressure chamber S2 may be an intermediate pressure area (i.e., an intermediate pressure chamber) and an oil supply passage 226*a* provided in the rotary shaft 226 may be at a higher pressure than the back pressure chamber S2. Further, the space enclosed by the rotary shaft 226, the main frame 230, and the orbiting scroll 240 may be a high-pressure area.

A back pressure seal 280 may be provided between the main frame 230 and the orbiting scroll 240 to distinguish the high pressure area from the intermediate pressure area S2. The back pressure seal 280 may serve as, for example, a sealing member.

In addition, the main frame 230 may be coupled with the fixed scroll 250 to define a space in which the orbiting scroll 240 may be arranged to perform an orbiting motion. That is, this structure may be configured to surround the rotary shaft 226 such that rotational power can be transmitted to the compression unit 200 via the rotary shaft 226.

The fixed scroll 250, which serves as the first scroll, may be coupled to the bottom surface of the main frame 230.

Specifically, the fixed scroll 250 may be arranged under the main frame 230.

The fixed scroll 250 may include a fixed scroll head plate (second head plate) 254 having a substantially circular shape, a fixed scroll sidewall portion 255 protruding upward from the outer circumferential portion of the second head plate 254, a fixed wrap 251 protruding from the upper surface of the second head plate 254 and meshing (i.e., engaging) with an orbiting wrap 241 of the orbiting scroll 240, which will be described later, to form the compression chamber S1, and a fixed scroll bearing accommodation portion 252 (hereinafter referred to as a second bearing accommodation portion) formed at the center of the back surface (i.e., lower surface) of the second head plate 254 and penetrated by the rotary shaft 226.

The second head plate 254 may be provided with a discharge port 253 for guiding the compressed refrigerant from the compression chamber S1 to the inner space of the discharge cover 270. Further, the position of the discharge port 253 may be set in consideration of a required discharge pressure or the like.

Here, the discharge port 253 is arranged to face the lower shell 214. Accordingly, the discharge cover 270 for accommodating the discharged refrigerant and guiding the refrigerant to a fixed scroll discharge hole 256*b*, which will be described later, so as not to be mixed with oil may be coupled to the bottom surface (i.e., lower surface) of the fixed scroll 250.

The discharge cover 270 may be hermetically coupled to the bottom surface of the fixed scroll 250 to separate the refrigerant discharge passage from the oil reservoir space V4. The discharge cover 270 may be provided with a through hole (not shown) through which an oil feeder 271, which is coupled to a sub-bearing 226*g* of the rotary shaft 226 constituting a second bearing and submerged in the oil reservoir space V4 of the casing 210, is arranged.

For reference, the discharge cover 270 is also referred to as a muffler, and a detailed description thereof will be given later.

The outer circumferential portion of the second sidewall portion 255 may be in contact with the inner circumferential surface of the cylindrical shell 211 and the upper end portion of the second sidewall portion 255 may be in contact with the lower end portion of the first sidewall portion 231.

The second sidewall portion 255 may be provided with a fixed scroll discharge hole 256*b* (hereinafter referred to as a second discharge hole) penetrating the second sidewall portion 255 in the axial direction to form a refrigerant passage together with the first discharge hole 231*a*.

The second discharge hole 256*b* may be formed so as to correspond to the first discharge hole 231*a*. The inlet of the second discharge hole 256*b* may be connected to the inner space of the discharge cover 270 and the outlet of the second discharge hole 256*b* may be connected to the inlet of the first discharge hole 231*a*.

Here, the second discharge hole 256*b* and the first discharge hole 231*a* may be formed to connect the third space V3 and the second space V2 such that the refrigerant discharged from the compression chamber S1 into the inner space of the discharge cover 270 is guided to the second space V2.

The second sidewall 255 may be provided with a refrigerant suction pipe 218 connected to the suction side of the compression chamber S1. In addition, the refrigerant suction pipe 218 may be arranged spaced apart from the second discharge hole 256*b*.

The second shaft support 252 may protrude from the lower surface of the second head plate 254 toward the oil reservoir space V4.

The second shaft support 252 may be provided with a second bearing such that a sub-bearing 226*g* of the rotary shaft 226, which will be described later, is inserted into and supported by the second bearing.

In addition, the lower end portion of the second shaft support 252 may be bent toward the center of the shaft to support the lower end of the sub-bearing 226*g* of the rotary shaft 226 to form a thrust bearing surface.

The orbiting scroll 240, which serves as the second scroll, may be arranged between the main frame 230 and the fixed scroll 250.

Specifically, the orbiting scroll 240 may be coupled to the rotary shaft 226 to form a pair of two compression chambers S1 between the fixed scroll 250 and the orbiting scroll 240 while making an orbiting motion.

The orbiting scroll 240 may include an orbiting scroll head plate 245 (hereinafter referred to as a third head plate) having a substantially circular shape, an orbiting wrap 241 protruding from the lower surface of the third head plate 245 and engaged with the fixed wrap 251, and a rotary shaft coupling portion 242 provided at the center of the third head plate 245 and rotatably coupled to an eccentric portion 226*f* of the rotary shaft 226, which will be described later.

In the case of the orbiting scroll 240, the outer circumferential portion of the third head plate 245 may be located at the upper end portion of the second sidewall portion 255 and the lower end portion of the orbiting wrap 241 may be in close contact with the upper surface of the second head plate 254 so as to be supported by the fixed scroll 250.

The outer circumferential portion of the rotary shaft coupling portion 242 is connected to the orbiting wrap 241 to form the compression chamber S1 together with the fixed wrap 251 during the compression operation.

For reference, the fixed wrap 251 and the orbiting wrap 241 may be formed in an involute shape, or may be formed in various other shapes.

Here, the involute shape refers to a curve corresponding to a trajectory drawn by an end of a thread when the thread wound around a base circle having an arbitrary radius is released.

The eccentric portion 226*f* of the rotary shaft 226 may be inserted into the rotary shaft coupling portion 242. The eccentric portion 226*f* inserted into the rotary shaft coupling portion 242 may overlap the orbiting wrap 241 or the fixed wrap 251 in the radial direction of the compressor.

Here, the radial direction may refer to a direction (i.e., the lateral direction) perpendicular to the axial direction (i.e., the vertical direction). More specifically, the radial direction may refer to a direction extending inward from the outside outward from the inside with respect to the rotatory shaft.

As described above, when the eccentric portion 226*f* of the rotary shaft 226 is arranged through the head plate 245 of the orbiting scroll 240 to radially overlap the orbiting wrap 241, the repulsive force of the refrigerant and the compressive force may be applied to the same plane with respect to the third head plate 245, and may thus be canceled to a certain degree.

The rotary shaft 226 may be coupled to the drive motor 220 and be provided with an oil supply passage 226*a* for guiding the oil contained in the oil reservoir space V4 of the casing 210 upward.

Specifically, the upper portion of the rotary shaft 226 may be press-fitted to the center of the rotor 224, and the lower portion thereof may be coupled to the compression unit 200 and supported in the radial direction.

Accordingly, the rotary shaft 226 may transmit the rotational power of the drive motor 220 to the orbiting scroll 240 of the compression unit 200. Thereby, the orbiting scroll 240 eccentrically coupled to the rotary shaft 226 makes an orbiting movement with respect to the fixed scroll 250.

The main bearing 226*c* may be formed at a lower portion of the rotary shaft 226 so as to be inserted into the first shaft support 232*a* of the main frame 230 and radially supported. The sub-bearing 226*g* may be formed at the lower portion of the main bearing 226*c* so as to be inserted into the second shaft support 252 of the fixed scroll 250 and radially supported.

The eccentric portion 226*f* may be formed between the main bearing 226*c* and the sub-bearing 226*g* so as to be inserted into and coupled to the rotary shaft coupling portion 242 of the orbiting scroll 240.

The main bearing 226*c* and the sub-bearing 226*g* may be coaxially arranged so as to have the same axial center. On the other hand, the eccentric portion 226*f* may be arranged so as to be eccentric in the radial direction with respect to the main bearing 226*c* or the sub-bearing 226*g*.

For reference, the eccentric portion 226*f* may have an outer diameter less than the outer diameter of the main bearing 226*c* and larger than an outer diameter of the sub-bearing 226*g*. In this case, the rotary shaft 226 may be easily coupled through the respective bearing accommodation portions 232*a* and 252 and the rotary shaft coupling portion 242.

Alternatively, the eccentric portion 226*f* may not be integrated with the rotary shaft 226 but may be formed using a separate bearing. In this case, the outer diameter of the sub-bearing 226*g* may not be less than the outer diameter of the eccentric portion 226*f*, and the rotary shaft 226 may be inserted into and coupled to the respective bearing accommodation portions 232*a* and 252 and the rotary shaft coupling portion 242.

An oil supply passage 226*a* for supplying the oil from the oil reservoir space V4 to the outer circumferential surfaces of the bearings 226*c* and 226*g* and the outer circumferential surface of the eccentric portion 226*f* may be formed in the rotary shaft 226. In addition, the bearings 226*c* and 226*g* and the eccentric portion 226*f* of the rotary shaft 226 may be provided with oil holes 228*a*, 228*b*, 228*d*, and 228*e* extending from the oil supply passage 226*a* to the outer circumferential surfaces in a penetrating manner.

For reference, the oil guided upward through the oil supply passage 226*a* may be discharged through the oil holes 228*a*, 228*b*, 228*d*, and 228*e* and supplied to the bearing surface or the like.

An oil feeder 271 for pumping the oil filling the oil reservoir space V4 may be coupled to the lower end of the rotary shaft 226, that is, the lower end of the sub-bearing 226*g*.

The oil feeder 271 may include an oil supply pipe 273 inserted into and coupled to the oil supply passage 226*a* of the rotary shaft 226, and an oil intake member 274 inserted into the oil supply pipe 273 to suction the oil.

Here, the oil supply pipe 273 may be arranged through the through hole of the discharge cover 270 so as to be submerged in the oil reservoir space V4, and the oil intake member 274 may function like a propeller.

Although not shown in the drawings, a trochoid pump (not shown) may be provided in the sub-bearing 226*g* or the discharge cover 270 in place of the oil feeder 271 to forcibly pump the oil contained in the oil reservoir space V4 upward.

Although not shown in the drawings, the scroll compressor according to the embodiment of the present disclosure may further include a first sealing member (not shown) for sealing the gap between the upper end of the main bearing 226*c* and the upper end of the main frame 230, and a second sealing member (not shown) for sealing the gap between the lower end of the sub-bearing 226*g* and the lower end of the fixed scroll 250.

For reference, with the first and second sealing members, the oil may be prevented from flowing out of the compression unit 200 along the bearing surface, thereby realizing a differential-pressure oil supply structure and preventing reverse flow of the refrigerant.

The rotor 224 or the rotary shaft 226 may be coupled with a balance weight 227 for suppressing noise vibration.

For reference, the balance weight 227 may be arranged in a space between the drive motor 220 and the compression unit 200, that is, the second space V2.

Hereinafter, operation of the scroll compressor 1 according to the embodiment of the present disclosure will be described.

When power is applied to the drive motor 220 to generate a rotational force, the rotary shaft 226 coupled to the rotor 224 of the drive motor 220 begins to rotate. Then, the orbiting scroll 240 eccentrically coupled to the rotary shaft 226 is pivotally moved with respect to the fixed scroll 250 to form the compression chamber S1 between the orbiting wrap 241 and the fixed wrap 251. The compression chamber S1 may be formed in several stages in succession as the volume gradually decreases toward the center.

The refrigerant supplied from the outside of the casing 210 through the refrigerant suction pipe 218 may be directly introduced into the compression chamber S1. The refrigerant may be compressed as it is moved toward the discharge chamber of the compression chamber S1 by the orbiting motion of the orbiting scroll 240. Then, the refrigerant may be discharged from the discharge chamber to the third space V3 through the discharge port 253 of the fixed scroll 250.

Thereafter, the compressed refrigerant discharged into the third space V3 flows to the inner space of the casing 210 (i.e., the second space V2 and the first space V1) through the second discharge hole 256*b* and the first discharge hole 231*a*, and is then discharged from the casing 210 through the refrigerant discharge pipe 216.

Here, the refrigerant discharged into the third space V3 may be guided to the second discharge hole 256*b* by the discharge cover 270 without being leaked to the oil reservoir space V4.

Figure 2B:
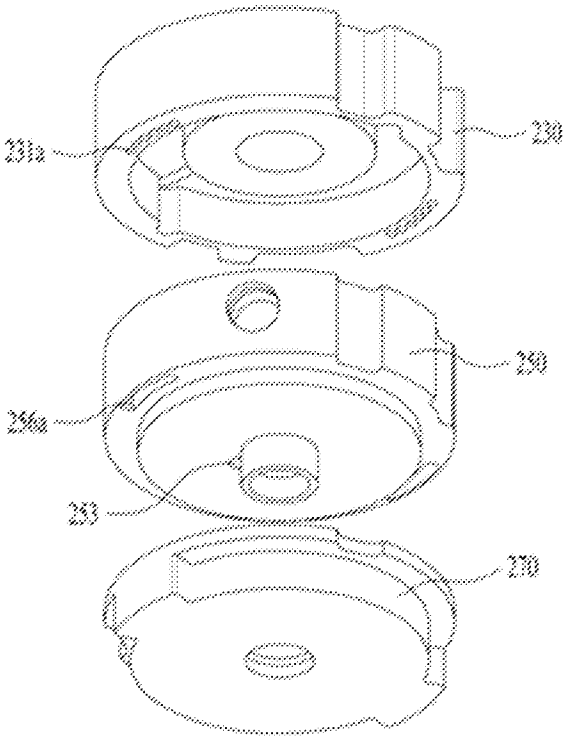
FIGS. 2A and 2B are exploded perspective views of a compression unit of the scroll compressor with discharge holes having a constant diameter.
Figure 2A:
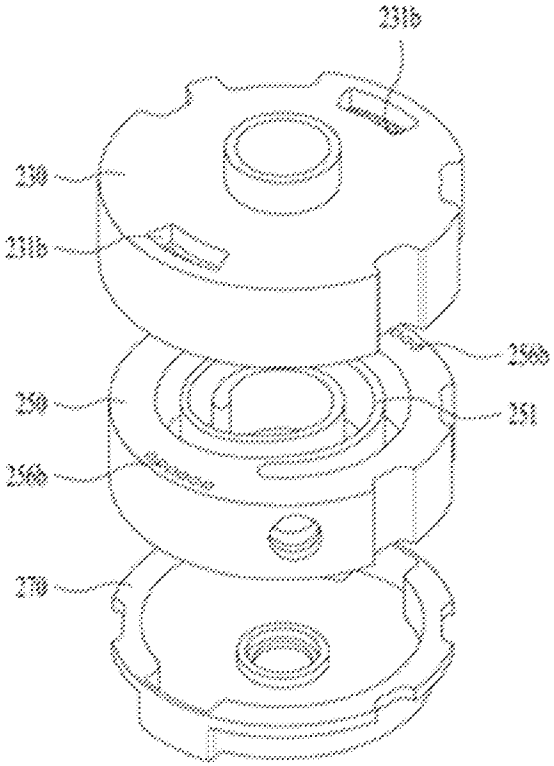

FIGS. 2A and 2B are exploded perspective views of the compression unit 200 of the scroll compressor 1 with discharge holes 231*a* and 256*b* having a constant diameter. FIG. 2A is an exploded perspective view seen from the top and FIG. 2B is an exploded perspective view seen from the bottom. Referring to FIGS. 2A and 2B, the main frame 230 and the fixed scroll 250 are vertically coupled, and the orbiting scroll 240 (not shown in the figure) is positioned therebetween.

The orbiting scroll 240 may include a spiral orbiting wrap 241 positioned in the spiral fixed wrap 251 of the fixed scroll 250. When the orbiting wrap 241 rotates around the rotary shaft, the spacing between the fixed wrap 251 and the orbiting wrap 241 may be changed and the volume of the compression chamber S1 therebetween may be changed to compress the refrigerant.

The refrigerant compressed in the compression chamber S1 exits through the discharge port 253 located in the fixed scroll 250 and moves to the closed space V3. The refrigerant moved to the closed space V3 rotates along the discharge cover 270 by rotation caused by the rotational force of the orbiting scroll 240 in the compression chamber S1 and moves upward through the discharge holes 231*a* and 256*b*. Then, the refrigerant moves to the second space V2 between the drive motor 220 and the compression unit 200.

In this process, however, the refrigerant introduced into the discharge holes 231*a* and 256*b* flows upward. Accordingly, the refrigerant moves through the narrow flow channel at a high speed as it is pushed up by the pressure. While the refrigerant moves through the narrow flow channel, noise may be generated.

Figure 3B:
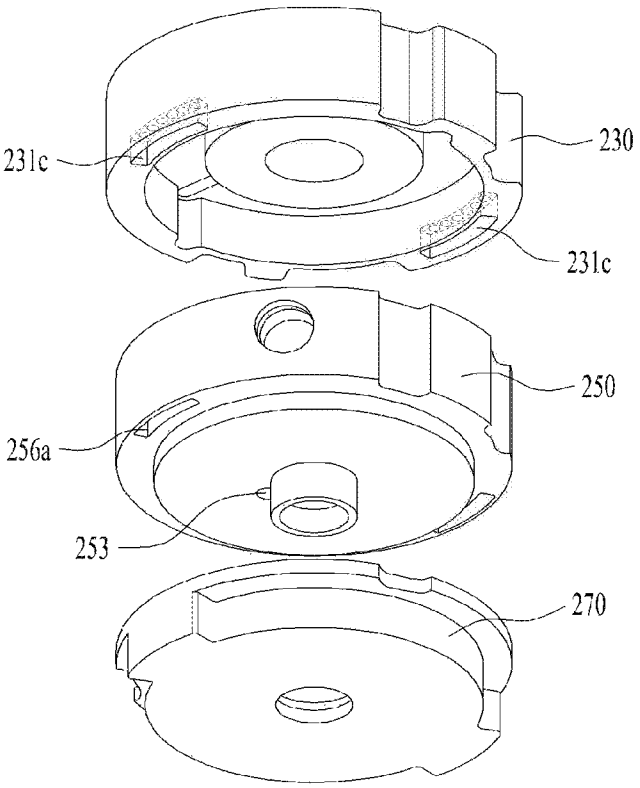
FIGS. 3A and 3B are exploded perspective views of the compression unit of the present disclosure.
Figure 3A:
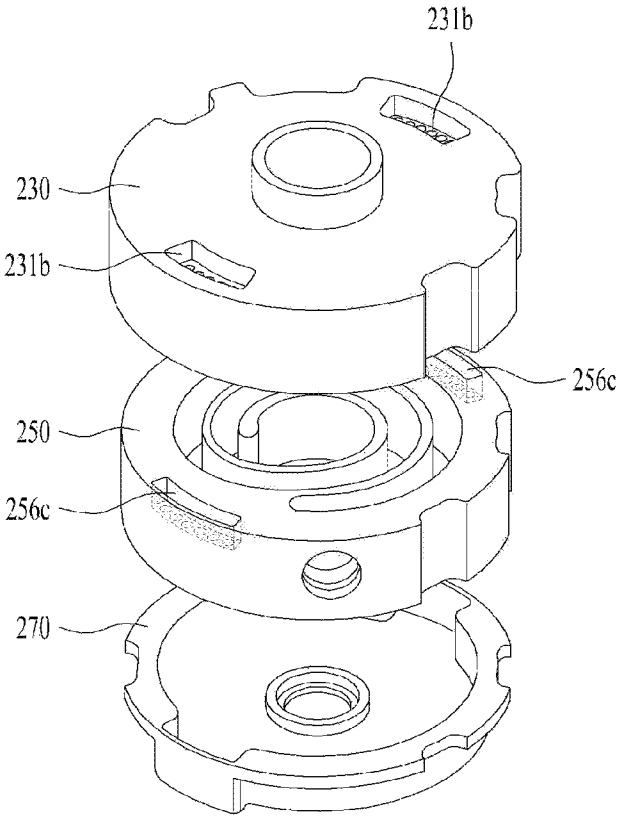

To reduce such noise, the structure of the discharge holes 231*a* and 256*b* may be improved. FIGS. 3A and 3B are exploded perspective views of the compression unit 200 of the present disclosure. FIG. 3A is an exploded perspective view seen from the top and FIG. 3B is an exploded perspective view seen from the bottom.

Figure 4A:
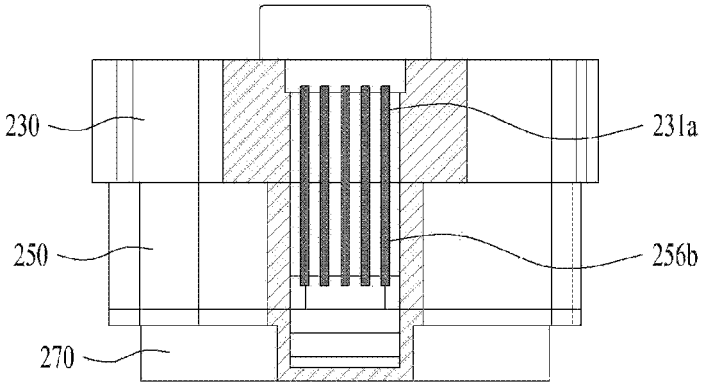
FIGS. 4A and 4B are views showing the discharge holes of the compression unit of FIGS. 2 and 3.
Figure 4B:
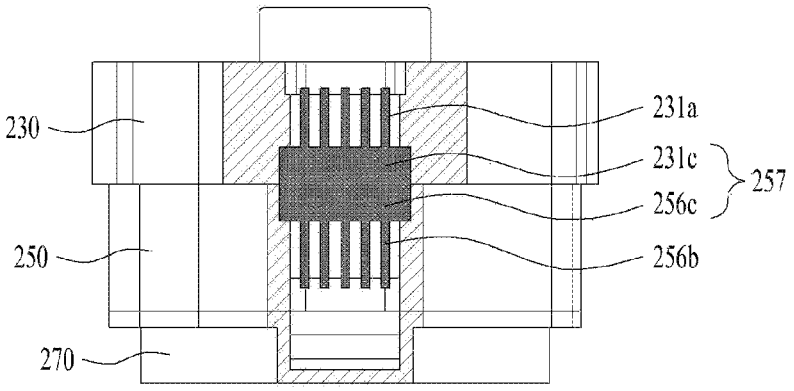

The discharge holes 231*a* and 256*b* shown in FIGS. 3A and 3B have different diameters (cross-sectional areas) at the inlet and the central portion thereof. FIGS. 4A and 4B are views showing the discharge holes 231*a* and 256*b* of the compression unit 200 of FIGS. 2A to 3B. In FIG. 4A, which illustrates the embodiment of FIGS. 2A and 2B, the discharge holes 231*a* and 256*b* have a constant diameter from the bottom to the top of the holes. In FIG. 4B, which illustrates the embodiment of FIGS. 3A and 3B, the area of the middle portion 257 of the discharge holes 231*a* and 256*b* is larger than the area of the inlet 231*a* or the outlet 256*b*.

As shown in FIGS. 3A and 3B, the diameter of at least one of a portion of the second discharge hole 256*b* at a lower portion of the main frame 230 or a portion of the first discharge hole 231*a* located at an upper portion of the fixed scroll 250 may be increased.

That is, the expanded portion 257 of the discharge holes 231*a* and 256*b* may include only a portion 231*c* positioned in the main frame 230 and connected to the first discharge hole 231*a*. In addition, the expanded portion 257 of the discharge holes 231*a* and 256*b* may include only a portion 256*c* positioned in the fixed scroll 250 and connected to the second discharge hole 256*b*. Alternatively, as shown in FIG. 4B, the portion 231*c* connected to the first discharge hole

231*a* and the portion 256*c* connected to the second discharge hole 256*b* may be combined to form one expanded flow channel 257.

Figure 5A:
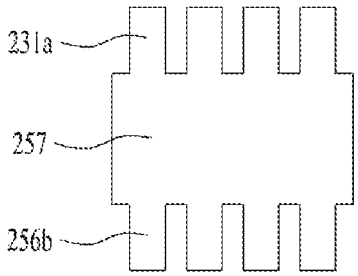
FIGS. 5A to 5C are views showing various embodiments of the discharge hole of the present disclosure.
Figure 5B:
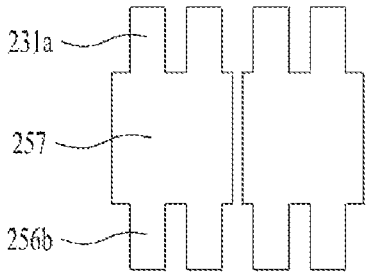
Figure 5C:
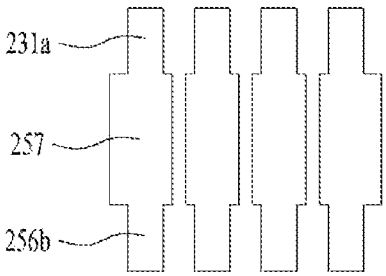

FIGS. 5A to 5C are views showing various embodiments of the discharge hole of the present disclosure. As shown in FIG. 5A, the expanded flow channel 257 having an inlet and outlet each including a plurality of discharge holes 231*a*, 256*b* distinguished from each other, and a middle portion merging the plurality of discharge holes 231*a* and 256*b* into one discharge hole.

The merged expanded flow channel 257 may be formed by integrating all the discharge holes 231*a* and 256*b* as shown in FIG. 5A or by integrating only some of the discharge holes 231*a* and 256*b* as shown in FIG. 5B. Alternatively, as shown in FIG. 5C, each of the discharge holes 231*a* and 256*b* may include, in the middle thereof, an individual expanded flow channel 257 having a cross-sectional area larger than that of the inlet and the outlet of the discharge hole. The expanded flow channel 257 may be referred to as a muffler because it has a noise reduction effect.

At least one of the inlet of the first discharge hole 231*a* in the bottom surface of the fixed scroll 250 or the outlet of the second discharge hole 256*b* in the top surface of the main frame 230 may include a flow channel guide 231*b*, 256*a* concavely depressed in the corresponding surface. The flow channel guides 231*b* and 256*a* may guide the refrigerant into the discharge holes 231*a* and 256*b* and guide the refrigerant ejected from the discharge holes 231*a* and 256*b* toward the refrigerant flow channel groove 212*a*.

As shown in FIGS. 3A and 3B, the discharge cover 270 may include a bottom plate and a cylindrical sidewall positioned on the circumference of the bottom plate. Only a portion of the discharge cover 270 where the discharge holes 231*a* and 256*b* are located may be concavely depressed. Thus, the refrigerant that has moved along the wall surface of the discharge cover 270 may be guided to move in the concave portion of the discharge cover 270 toward the discharge holes 231*a* and 256*b*.

The discharge holes 231*a* and 256*b* may be formed at the center of the fixed scroll 250 and the main frame 230, that is, at a position spaced apart from the rotary shaft. The refrigerant that has moved along the wall surface of the discharge cover 270 may be naturally guided to the discharge holes 231*a* and 256*b* located at the outside and be discharged. In addition, as shown in FIGS. 3A and 3B, the discharge holes 231*a* and 256*b* may be formed at various places along the circumference of the compression unit 200 in a distributed manner.

When the cross-sectional area of the discharge holes 231*a* and 256*b* are changed as described above, the sound transmitted along the discharge holes 231*a* and 256*b* may not be significantly generated and thus corresponding noise may be reduced. A better noise reduction effect may be obtained when the cross-sectional area of the discharge holes 231*a* and 256*b* is changed in a stepped manner, as shown in FIGS. 5A to 5C, than when the cross-sectional area is gradually changed along an inclined surface.

Figure 6:
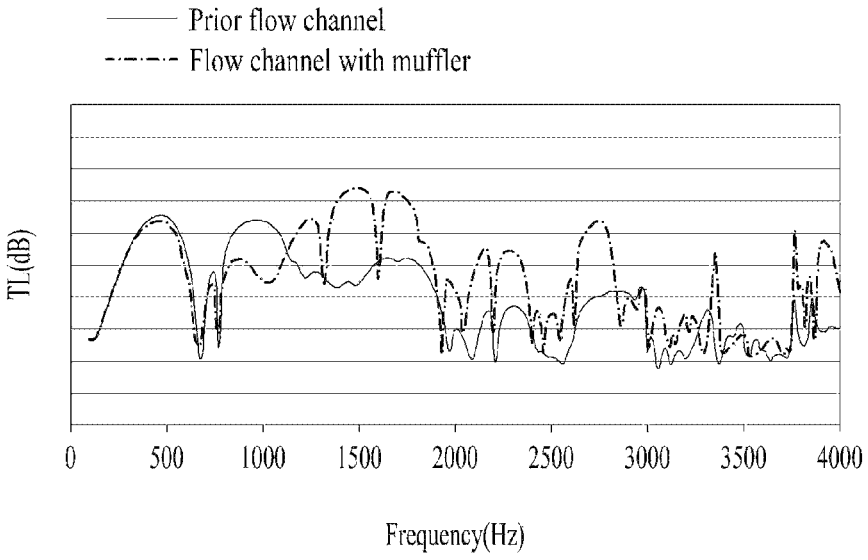
FIG. 6 is a graph depicting a noise reduction effect depending on presence or absence of an expanded flow channel in the discharge holes according to an embodiment of the present disclosure.

FIG. 6 is a graph depicting a noise reduction effect depending on presence or absence of the expanded flow channel 257 in the discharge holes 231*a* and 256*b* according to an embodiment of the present disclosure. The graph depicts the degree of sound loss at each frequency during transmission. In the graph, the vertical axis represents a transmission loss (TL). That is, as the sound loss increases, the noise reduction effect may be enhanced. When the muffler 257 is provided (as in the embodiment of FIGS. 3A and 3B), the noise reduction effect may be better than when the muffler 257 is not provided (as in the embodiment of FIGS. 2A and 2B).

Figure 7:
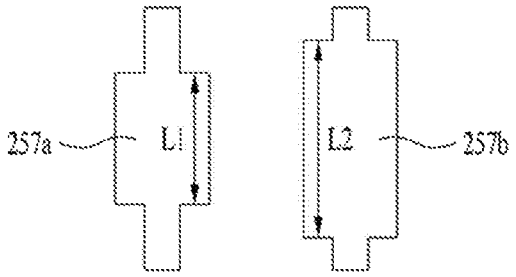
FIG. 7 is a graph depicting a noise reduction effect depending on the length of the expanded flow channel of the discharge holes according to an embodiment of the present disclosure.
Figure 7:
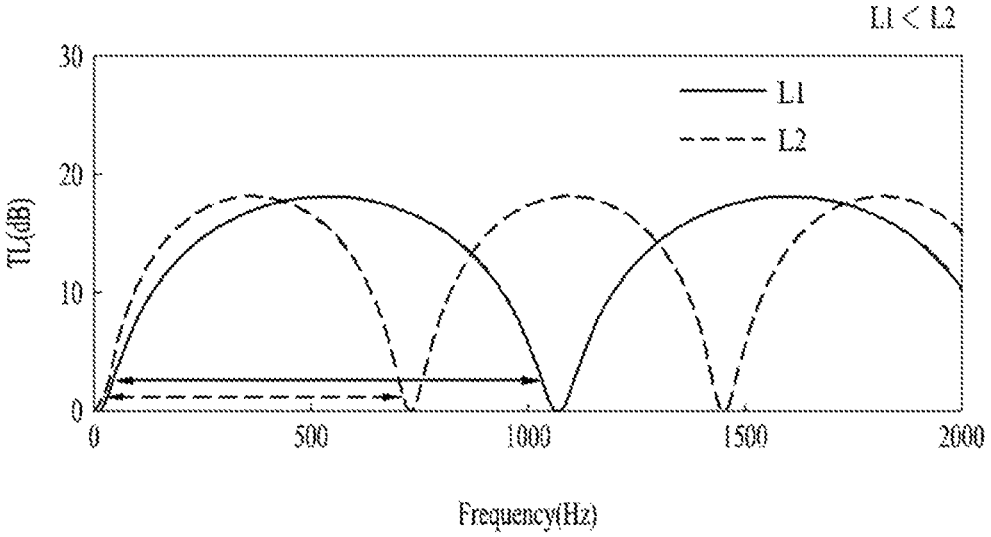

FIG. 7 is a graph depicting a noise reduction effect depending on the length of the expanded flow channel 257 of the discharge holes according to an embodiment of the present disclosure. The length of the expanded flow channel 257 is related to a resonant frequency. The resonant frequency may be obtained at a wavelength twice the length of the expanded flow channel 257. At the resonant frequency, the cross-sectional area of the discharge holes is changed and thus the wavelength is disturbed. Thereby, the noise reduction effect may be lowered.

Referring to FIG. 7, the noise reduction effect varies according to a predetermined period, which is determined by the length of the expanded flow channel 257. The length of the expanded flow channel 257 is related to the resonant frequency of sound. Sound having a length corresponding to $(2n-1)/4$ times the length L of the expanded flow channel and sound having a length corresponding to $n/2$ times the length L of the expanded flow channel may be effectively reduced.

Therefore, it is necessary to identify the main frequency band of the noise to determine the length of the expanded flow channel 257 avoiding the length corresponding to a wavelength in the frequency band. For example, when large noise is generated in a 750 Hz band, it may be better to employ an expanded flow channel 257*a* having the length of L1 than to employ an expanded flow channel 257*b* having the length of L2. To reduce noise in a 1000 Hz band, employing the expanded flow channel 257*b* having the length of L2 may obtain a better noise reduction effect than employing the expanded flow channel 257*a* having the length of L1 (where $L1<L2$).

Figure 8:
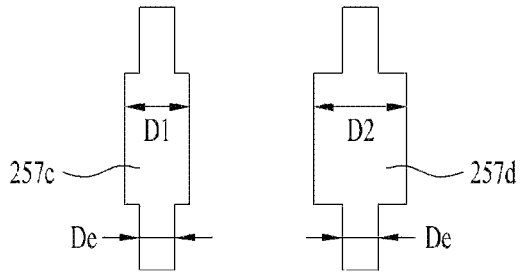
FIG. 8 is a graph depicting a noise reduction effect depending on the cross-sectional area of the expanded flow channel of the discharge holes according to an embodiment of the present disclosure.
Figure 8:
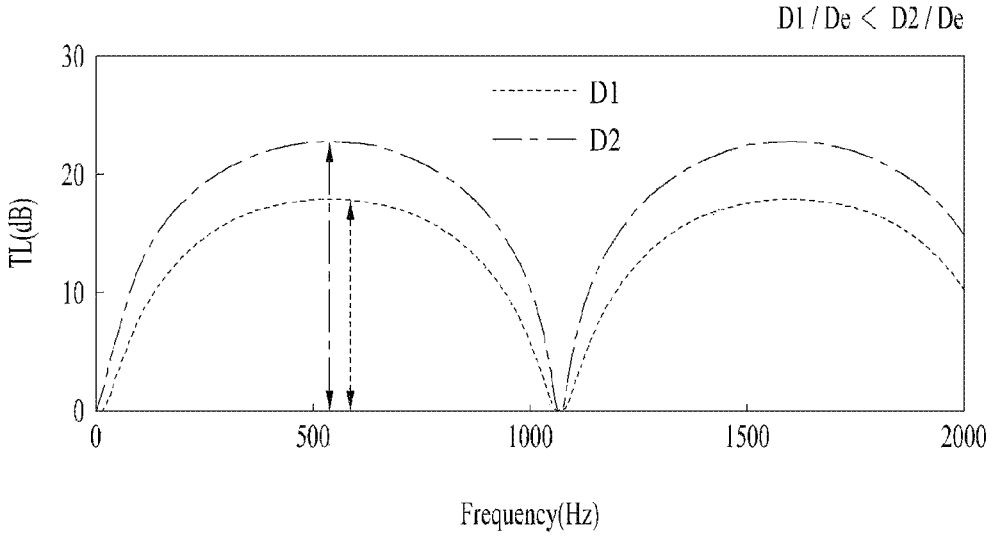

FIG. 8 is a graph depicting a noise reduction effect depending on the cross-sectional area of the expanded flow channel 257 of the discharge holes 231*a* and 256*b* according to an embodiment of the present disclosure. Assuming that the cross section of the expanded flow channel 257 is a circle, the noise reduction effect will be described based on the diameter of the cross section because the diameter is related to the cross-sectional area.

Referring to the graph, the discharge holes including an expanded flow channel 257*d* having a large cross-sectional area have a better noise reduction effect than the discharge holes including an expanded flow channel 257*c* having a small cross-sectional area (where $D2>D1$). The ratio between the diameter of the expanded flow channel 257 and the diameter De of the inlet is more important than the absolute value of the diameter of the expanded flow channel 257. Using the expanded flow channel 257*d* having the diameter D2, which is greater than the diameter De of the inlet, may obtain an excellent noise reduction effect.

As described above, the scroll compressor including the discharge holes of the present disclosure may reduce noise generated during movement of the refrigerant in the discharge holes, through a simple structural change. Accordingly, usability of the scroll compressor may be improved.

In particular, by forming the expanded flow channel of the discharge holes to have a length corresponding to the wavelength of a noise to be reduced, the optimum noise reduction effect may be obtained.

As is apparent from the above description, the present disclosure has effects as follows.

According to the present disclosure, the noise generated when the refrigerant moves may be reduced.

In addition, vibration and noise generated by the refrigerant inside the compressor may be reduced.

It will be apparent to those skilled in the art that various substitutions, modifications, and variations can be made in the present disclosure without departing from the spirit and scope of the present disclosure. Thus, it is intended that the present disclosure cover the modifications and variations of this disclosure provided they come within the scope of the appended claims and their equivalents. Therefore, the present disclosure is not limited by the above-described embodiments and the accompanying drawings.

What is claimed is:

1. A scroll compressor comprising:

a casing;

a drive motor included in the casing;

a rotary shaft rotatable by the drive motor;

a main frame supporting the rotary shaft;

a fixed scroll connected to the main frame;

an orbiting scroll arranged between the main frame and the fixed scroll and eccentrically connected to the rotary shaft, the orbiting scroll configured to orbit relative to the fixed scroll and define a compression chamber in cooperation with the fixed scroll;

a discharge cover disposed on a first surface of the fixed scroll to define a closed space between the discharge cover and the first surface of the fixed scroll;

a discharge port defined at the fixed scroll and configured to fluidly connect the compression chamber to the closed space; and a discharge hole defined through the main frame and the fixed scroll and configured to fluidly connect the closed space to an outside of the main frame, wherein opposite ends of the discharge hole have cross-sectional areas that are different from a cross-sectional area of an expanded flow channel of the discharge hole disposed between the opposite ends, wherein the discharge hole comprises a plurality of inlets and a plurality of outlets defined at the opposite ends, and the expanded flow channel is defined between the plurality of inlets and the plurality of outlets, and wherein the expanded flow channel is in fluid communication with at least two of the plurality of inlets and at least two of the plurality of outlets.

2. The scroll compressor of claim 1, wherein the discharge hole comprises:

a first discharge hole defined at the main frame; and a second discharge hole defined at the fixed scroll and fluidly connected to the first discharge hole.

3. The scroll compressor of claim 2, wherein the first discharge hole has a plurality of openings defined at a first surface of the main frame and one opening defined at a second surface of the main frame, the second surface of the main frame being opposite to the first surface of the main frame and facing the fixed scroll, and the one opening being fluidly connected to the plurality of openings through the main frame.

4. The scroll compressor of claim 2, wherein the second discharge hole has a plurality of openings defined at the first surface of the fixed scroll and one opening in a second surface of the fixed scroll, the second surface of the fixed scroll being opposite to the first surface of the fixed scroll and facing the main frame, and the one opening being fluidly connected to the plurality of openings through the fixed scroll.

5. The scroll compressor of claim 1, wherein the expanded flow channel has a cross-sectional area greater than the cross-sectional areas of the opposite ends of the discharge hole.

6. The scroll compressor of claim 5, wherein the expanded flow channel fluidly communicates with all of the plurality of inlets and all of the plurality of outlets.

7. The scroll compressor of claim 5, wherein the discharge hole further comprises:

a first flow channel extending from one of the opposite ends;

a second flow channel extending from the expanded flow channel to the other of the opposite ends;

a first stepped portion between the first flow channel and the expanded flow channel; and a second stepped portion between the expanded flow channel and the second flow channel.

8. The scroll compressor of claim 5, wherein the scroll compressor is configured to reduce a noise of a wavelength corresponding to $(2n-1)/4$ times a length of the expanded flow channel better than a noise of a wavelength corresponding to $n/2$ times the length of the expanded flow channel, wherein n is a natural number.

9. The scroll compressor of claim 1, further comprising:

a first flow channel guide recessed from the first surface of the fixed scroll in an area of the fixed scroll corresponding to the discharge hole.

10. The scroll compressor of claim 1, further comprising:

a second flow channel guide recessed from a surface of the main frame in an area of the main frame corresponding to the discharge hole.

11. The scroll compressor of claim 1, wherein the discharge hole is defined at a sidewall of the main frame and a sidewall of the fixed scroll.

12. The scroll compressor of claim 11, wherein the discharge cover comprises:

a bottom; and a cover sidewall extending from an outer circumferential surface of the bottom and configured to be disposed on the fixed scroll, the cover sidewall includes a recessed portion corresponding to the discharge hole.

13. A scroll compressor comprising:

a rotary shaft;

a frame supporting the rotary shaft;

a fixed scroll connected to the frame;

an orbiting scroll arranged between the frame and the fixed scroll and connected to the rotary shaft, the orbiting scroll configured to orbit relative to the fixed scroll such that a compression chamber is defined by the orbiting scroll and the fixed scroll;

a discharge cover disposed on a first surface of the fixed scroll to define a space between the discharge cover and the first surface of the fixed scroll;

a discharge hole defined through the frame and the fixed scroll and configured to fluidly connect the closed space to an outside of the frame, wherein opposite ends of the discharge hole have cross-sectional areas that are different from a cross-sectional area of an expanded flow channel of the discharge hole disposed between the opposite ends, wherein the discharge hole comprises a plurality of inlets and outlets defined at the opposite ends, and the expanded flow channel is defined between the plurality of inlets and the plurality of outlets, and wherein the expanded flow channel is in fluid communication with at least two of the plurality of inlets and at least two of the plurality of outlets.

14. The scroll compressor of claim 13, wherein the discharge hole comprises:

a first discharge hole defined at the frame; and a second discharge hole defined at the fixed scroll and fluidly connected to the first discharge hole.

15. The scroll compressor of claim 14, wherein the first discharge hole has a plurality of openings defined at a first surface of the frame and one opening defined at a second surface of the frame, the second surface of the frame being opposite to the first surface of the frame and facing the fixed scroll, and the one opening being fluidly connected to the plurality of openings through the frame.

16. The scroll compressor of claim 14, wherein the second discharge hole has a plurality of openings defined at the first surface of the fixed scroll and one opening in a second surface of the fixed scroll, the second surface of the fixed scroll being opposite to the first surface of the fixed scroll and facing the frame, and the one opening being fluidly connected to the plurality of openings through the fixed scroll.

17. The scroll compressor of claim 13, wherein the expanded flow channel has a cross-sectional area greater than the cross-sectional areas of the opposite ends of the discharge hole.

18. The scroll compressor of claim 17, wherein the expanded flow channel fluidly communicates with all of the plurality of inlets and all of the plurality of outlets.

19. The scroll compressor of claim 17, wherein the discharge hole further comprises:

a first flow channel extending from one of the opposite ends;

a second flow channel extending from the expanded flow channel to the other of the opposite ends;

a first stepped portion between the first flow channel and the expanded flow channel; and a second stepped portion between the expanded flow channel and the second flow channel.

20. The scroll compressor of claim 13, further comprising:

a first flow channel guide recessed from the first surface of the fixed scroll in an area of the fixed scroll corresponding to the discharge hole; and a second flow channel guide recessed from a surface of the frame in an area of the frame corresponding to the discharge hole.

* * * * *